US005148780A

United States Patent [19]

Urano et al.

[11] Patent Number: 5,148,780

[45] Date of Patent: Sep. 22, 1992

[54] CYLINDER LINER AND METHOD FOR MANUFACTURING THE SAME

[75] Inventors: Keiichi Urano, Nagano; Kazunori Mizutani, Okaya; Nobuyuki Yamashita, Shiojiri, all of Japan

[73] Assignee: Teikoku Piston Ring Co., Ltd., Tokyo, Japan

[21] Appl. No.: 813,375

[22] Filed: Dec. 23, 1991

[51] Int. Cl.[5] ..... F02F 1/00

[52] U.S. Cl. ..... 123/193.2; 123/668; 29/888.06; 29/888.061

[58] Field of Search ..... 123/193.2, 193.1, 668, 123/669; 29/888.06, 888.061; 428/34.4

[56] References Cited

U.S. PATENT DOCUMENTS

| | | | |
|---|---|---|---|
| 3,903,951 | 9/1975 | Kaneko et al. | 29/888.06 |
| 4,395,442 | 7/1983 | Meise et al. | 123/193.2 |
| 4,495,907 | 1/1985 | Kamo | 123/193.2 |
| 4,523,554 | 6/1985 | Ryu | 123/193.2 |
| 4,921,734 | 5/1990 | Thorpe et al. | 123/193.2 |
| 5,000,127 | 3/1991 | Nishimura | 29/888.061 |

*Primary Examiner*—E. Rollins Cross
*Assistant Examiner*—Marguerite Macy
*Attorney, Agent, or Firm*—Hill, Van Santen, Steadman & Simpson

[57] ABSTRACT

A cylinder liner comprises an alloy plating film of Ni-B or Ni-P or Ni-Co-P formed on at least a part contacting with cooling liquid in an outer peripheral surface and further a nitrided layer formed on an inner peripheral surface to improve an anti-cavitation characteristic, a sliding characteristic and an anti-corrosion characteristic and facilitate a manufacturing of the cylinder liner.

3 Claims, 1 Drawing Sheet

CYLINDER LINER AND METHOD FOR MANUFACTURING THE SAME

BACKGROUND OF THE INVENTION

1. Field of the Invention

This invention relates to a cylinder liner for an internal combustion engine and a method for manufacturing the same.

2. Description of the Related Art

As a specific requirement for the internal combustion engine in recent years, there are requirements to get a long life and a low air pollution in addition to the conventional requirements of a high-speed operation and a high output.

Since an improvement over an output of the engine is accommodated by setting a super-charger, a piston ring and a cylinder liner are required to have a more anti-scuffing characteristic. In turn, as for the requirement of a low air pollution, there is increasingly required to apply an EGR, so that an anti-corrosion characteristic is required more.

In addition, in case that a long life of the engine is to be attained, a countermeasure against a cavitation at a jacket of an outer peripheral surface in the cylinder liner has become more important in addition to an improvement of anti-wear characteristic of the piston ring and the cylinder liner.

A cylinder liner applied a Tufftride treatment has been used due to the fact that there is a certain limitation only with an improvement of the cylinder liner material against the requirements of anti-scuffing, anti-corrosion and anti-wearing characteristics.

However, a nitriding treatment including a Tufftride treatment may not provide any countermeasure against the cavitation at the outer peripheral surface of the cylinder liner. In turn, as the anti-cavitation treatment performed at the outer peripheral surface, it is well known in the art to apply a hard chromium plating and this treatment is actually applied in some cylinder liners to show a certain effect.

Accordingly, there may be considered to get a cylinder liner of which outer peripheral surface is plated with hard chromium and of which inner peripheral surface is nitrided. However, if the nitriding treatment is applied after performing the hard chromium plating, a certain crack may be occurred in the hard chromium plating film to cause a hardness of the hard chromium film to be reduced, so that the cylinder liner made by this manufacturing method may not provide a sufficient anti-cavitation performance. In case that a hard chromium plating is applied after a nitriding treatment, a surplus step is added to a pre-plating process and an expenditure increases due to the fact that a close fitness of the hard chromium plating film on the nitrided layer in the outer peripheral surface and a throwing power are not well attained.

SUMMARY OF THE INVENTION

In view of the foregoing situation, the present invention has been invented, wherein it is an object of the present invention to provide a cylinder liner having a superior anti-cavitation, sliding and anti-corrosion characteristics and of which manufacturing is easy to perform and a method for manufacturing the cylinder liner.

The cylinder liner of the present invention is characterized in that a nickel alloy plating film is provided on at least a part of the liner having contact with cooling liquid in an outer peripheral surface, a nitrided layer is provided on an inner peripheral surface, and said nickel alloy is an alloy selected from the group consisting of Ni-B alloy, Ni-P alloy, and Ni-Co-P alloy.

The nitrided layer includes a soft nitriding treatment layer made by a Tufftride or the like in addition to a nitriding treatment layer made by a gas nitriding or the like.

Since at least a part of the liner having contact with cooling liquid (water or oil) in the outer peripheral surface of the cylinder liner is formed with a nickel alloy plating film of Ni-B or Ni-P or Ni-Co-P, it has a superior anti-cavitation characteristic. As to the anti-cavitation characteristic, comparing the hard chromium plating with the nickel alloy plating reveals the following points. The hard chromium plating has a porous characteristic and it generates certain cracks in its surface due to an etching treatment and the like. In case of no treatment such as an etching process or the like, it contains certain cracks therein and the cracks badly influence an anti-cavitation characteristic. In turn, the nickel alloy plating has no inter-cracks and there is no partially poor anti-cavitation characteristic, and so totally the nickel alloy plating has a more superior anti-cavitation characteristic than that of the hard chromium plating. In addition, the nitrided layer is formed on the inner peripheral surface, so that the surface has a superior sliding and anti-corrosion characteristics. Further, when the nitriding treatment is applied after the aforesaid alloy plating, no occurrence of cracks caused by a thermal expansion is found in the plating film and a hardness becomes higher than that before the nitriding treatment and such plating alloy is strengthened due to the high temperature procedure in the nitriding process, so that anti-cavitation characteristic is not damaged by the nitriding treatment. Accordingly, by selecting the alloy plating film of the present invention as the anti-cavitation film, it is possible to perform a manufacturing process of applying the nitriding treatment after performing the alloy plating, so that the cylinder liner having superior anti-cavitation, sliding and anti-corrosion characteristics can be easily manufactured.

DETAILED DESCRIPTION OF THE PREFERRED EMBODIMENTS

Figure 1:
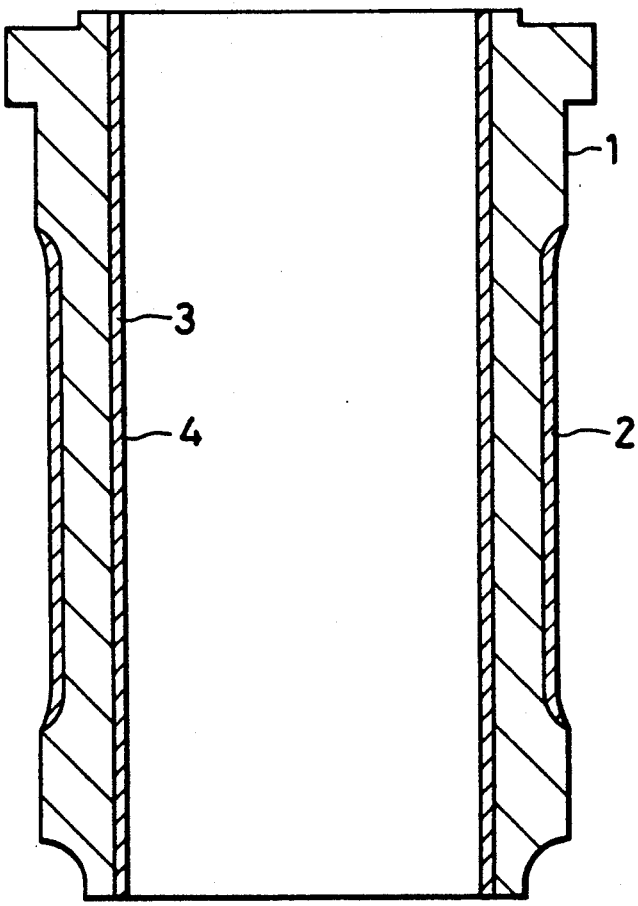
FIG. 1 is a longitudinal section for showing the cylinder liner of the present invention.

The aforesaid and other objects and features of the present invention will be made more apparent in reference to the following detailed description and the accompanying drawing.

As shown in the drawing, after a nickel alloy plating film 2 of Ni-B is applied to cover a part of the liner having contact with cooling liquid in the outer peripheral surface 1 of the cylinder liner which is made of flake graphite cast iron equivalent to FC25, then a Tufftride treatment (two hours at 580° C.) is carried out to form the nitrided layer 3 on the inner peripheral surface, and a compound layer at the surface having a high concentration of nitrogen in the nitrided layer 3 is removed to form the sliding surface 4. It is preferable that a thickness of the alloy plating film 2 is at least 30 $\mu$m in view of the anti-cavitation characteristic. In addition, in the event that a Tufftride treatment is carried out, a hardness of the alloy plating film 2 is reduced to about Hv 600. However, the anti-cavitation characteristic is sufficient.

Although in the aforesaid preferred embodiment, the nickel alloy is a Ni-B alloy, this is not limited to the Ni-B alloy but it may be a Ni-P alloy or a Ni-Co-P alloy.

As described above, the present invention made by the present inventors has been practically described in reference to its preferred embodiments and it is apparent that the present invention is not limited to the aforesaid preferred embodiments, but can be variously modified or changed without departing from its gist.

What is claimed is:

1. A cylinder liner comprising a nickel alloy plating film formed on at least a part of the liner having contact with cooling liquid on an outer peripheral surface, a nitrided layer formed on an inner peripheral surface, and said nickel alloy being an alloy selected from the group consisting of Ni-B alloy, Ni-P alloy, and Ni-Co-P alloy.

2. A cylinder liner according to claim 1 in which a thickness of said alloy plating film is more than 30 $\mu$m.

3. A method for manufacturing a cylinder liner comprising the steps of:

forming a nickel alloy plating film on at least a part of the liner having contact with cooling liquid in an outer peripheral surface, said nickel alloy being an alloy selected from the group consisting of Ni-B alloy, Ni-P alloy, and Ni-Co-P alloy; and forming a nitrided layer on an inner peripheral surface after said alloy plating step.

* * * * *